US005373663A

United States Patent [19]

Turini

[11] Patent Number: 5,373,663

[45] Date of Patent: Dec. 20, 1994

[54] DEVICE FOR MOTORIZING AN OVERHEAD SWINGING DOOR FOR A GARAGE OR THE LIKE, AND MOTORIZED OVERHEAD SWINGING DOOR PROVIDED WITH THIS DEVICE

[75] Inventor: Alessandro Turini, Castenago, Italy

[73] Assignee: Aprimatic S.p.A., Bologna, Italy

[21] Appl. No.: 102,825

[22] Filed: Aug. 6, 1993

[30] Foreign Application Priority Data

Oct. 9, 1992 [IT] Italy ..... T092 A 000816

[51] Int. Cl.[5] ..... E05F 15/00

[52] U.S. Cl. ..... 49/200; 49/204; 49/280

[58] Field of Search ..... 49/200, 204, 199, 197, 49/280; 160/189

[56] References Cited

U.S. PATENT DOCUMENTS

| | | | |
|---|---|---|---|
| 1,843,973 | 2/1932 | Dickason | 49/204 |
| 1,980,303 | 11/1934 | Thompson | 49/200 |
| 2,163,394 | 6/1939 | Clark | 49/204 |
| 2,388,182 | 10/1945 | Redding et al. | 49/204 X |
| 4,819,376 | 4/1989 | Taddei | 49/204 X |
| 5,036,899 | 8/1991 | Mullet | 49/200 X |

*Primary Examiner*—Philip C. Kannan

*Attorney, Agent, or Firm*—Sughrue, Mion, Zinn, Macpeak & Seas

[57] ABSTRACT

An overhead swinging door is swingably mounted on two side supports slidable in two vertical guides and each connected to a counterweight by a cable re-directed over an upper pulley. On at least one of the door sides, the counterweight is also connected to the respective side support by a chain which forms an endless ring with the cable and is re-directed over a lower wheel driven by a motor and reducing gear unit which is preferably located within the side upright of the door frame.

9 Claims, 2 Drawing Sheets

DEVICE FOR MOTORIZING AN OVERHEAD SWINGING DOOR FOR A GARAGE OR THE LIKE, AND MOTORIZED OVERHEAD SWINGING DOOR PROVIDED WITH THIS DEVICE

BACKGROUND OF THE INVENTION

The present invention relates to motorized overhead swinging doors for garages and the like, of the known type comprising:

a fixed support frame, including two side vertical guides, two side supports, movable within said side guides, a door structure, swingably mounted around a horizontal axis on said side supports and also connected to the fixed frame by two pivoted side arms, a pair of counterweights, slidably along a vertical direction within said fixed frame and each connected to a respective one of said side supports by cable means re-directed over a respective upper pulley having a fixed axis, and an engine unit for driving the door.

The doors of this type which have been produced up to now have motorized control mechanism which are relatively complicated and costly, also requiring long and complicated operations to be adapted on doors which are not orginally provided with a motorized control.

SUMMARY OF THE INVENTION

The object of the present invention is that of providing a motorized overhead swinging door which has a very simple and economic structure and which at the same time is efficient in operation and reliable.

A further object of the invention is that of providing a device for motorizing overhead swinging doors which is simple and economic and may be adapted with a few and simple operations on doors which originally are not provided with a motorizing device.

In order to achieve said first object, the invention provides a motorized overhead swinging door of the type which has been indicated above, characterized in that at least one of said counterweights is connected to the respective side support both, on the upper side, by said cable means, and, on the lower side, by chain means which form an endless ring with said cable means, said chain means being re-directed around a respective lower wheel, said engine unit being arranged to drive said lower wheel.

Due to said features, the invention allows a dramatic reduction in the costs and complexity of the motorizing device with respect to the solutions provided up to now, and further ensures a very high reliability and easiness of mantainence.

The invention is applicable to any type of overhead swinging door, also with a different balancing arrangement and for any use (for a garage or others).

It is to be submitted, furthermore, that the terms "cable means" and "chain means" which appear in the present description and in the following claims are intended to indicate any transmission element equivalent to a cable or a chain.

The above described arrangement may be adopted on one side only or on both sides of the door.

In a preferred embodiment, the door according to the invention is further characterized in that it includes a bolt device driven by a solenoid for locking the door in the closed condition. Preferably, the bolt device includes a bolt carried by the fixed frame and a coupling element for cooperation with the bolt carried by the door, said bolt being elastically biased into its closed position and being movable towards the opened position by solenoid control means. When the door is locked, this coupling element can be retracted towards a bolt disengaging position by a manually operable mechanism, so as to allow the opening of the door in case of an interruption of supply to the solenoid control means. Said manually operable mechanism includes a key-operable latch and may be the conventional mechanism with which any non-motorized overhead swinging door is provided.

The invention obviously also provides the motorizing device per se, which can be adapted on a overhead swinging door which is not originally provided with a motorized device.

BRIEF DESCRIPTION OF THE DRAWINGS

Further features and advantages of the invention will become apparent from the following description with reference to the annexed drawings, given purely by way of non limiting example, in which.

DETAILED DESCRIPTION OF THE INVENTION

Figure 1:
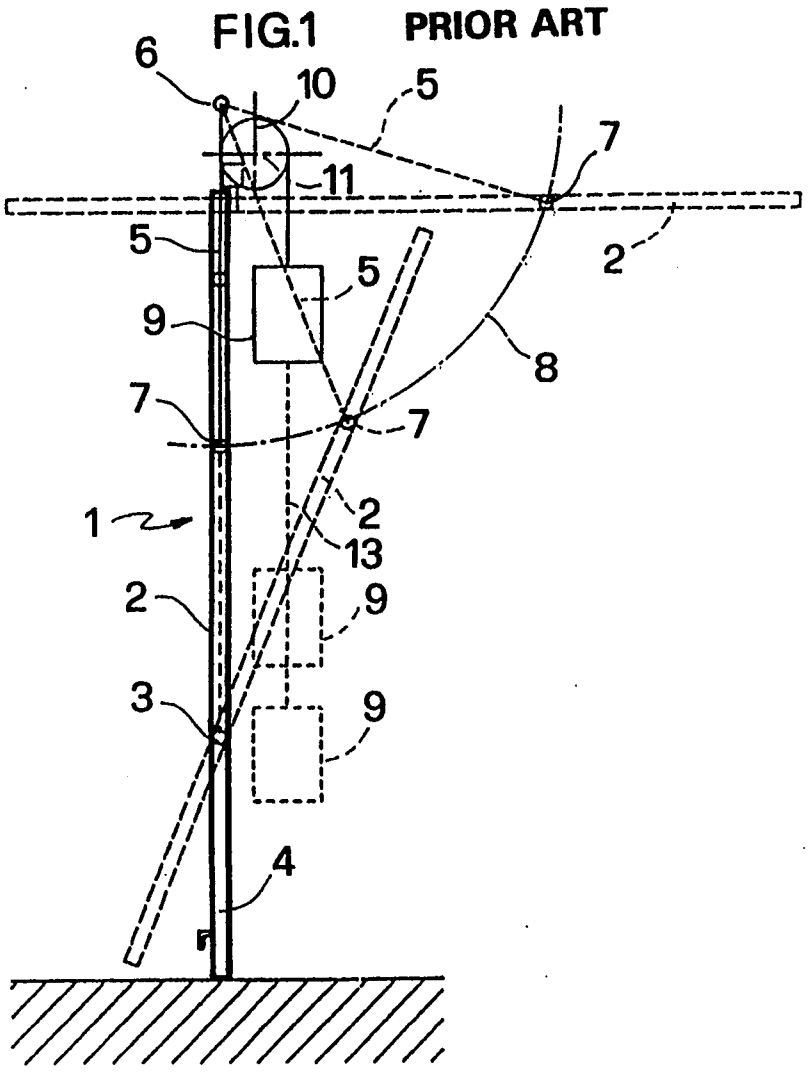
FIG.1 PRIOR ART
FIG. 1 shows a diagrammatic side view of an overhead swinging door according to a prior art, which is not provided with a motorizing device.

In FIG. 1, reference numeral 1 generally designates an overhead swinging door according to the prior art, which is not provided with a motorizing device. The door 1 comprises a door structure 2 swingably mounted around a horizontal axis on two side supports 3 which are movable in two vertical side guides 4 forming parts of the fixed frame of the door. In FIG. 1, the closed vertical position of the door is shown by undotted line, whereas by dotted lines there are indicated the opened horizontal position and an intermediate position.

The door is also connected to the fixed structure by two side arms 5 each pivoted in 6 to the fixed structure. The opposed end 7 of each arms is pivoted to the door 2 and is therefore constrained to move along a circular path 8.

Each side support 3 is also connected to a respective counterweight 9 by a metal cable 13 which is re-directed around an upper pulley 10 freely rotatably mounted on the fixed structure around a horizontal axis 11. The door 1 is also provided, in the usual way, with a handle 21 for the manual opening and closing operation, as well as with a key-operable latch for locking the door in the closed position.

Figure 2:
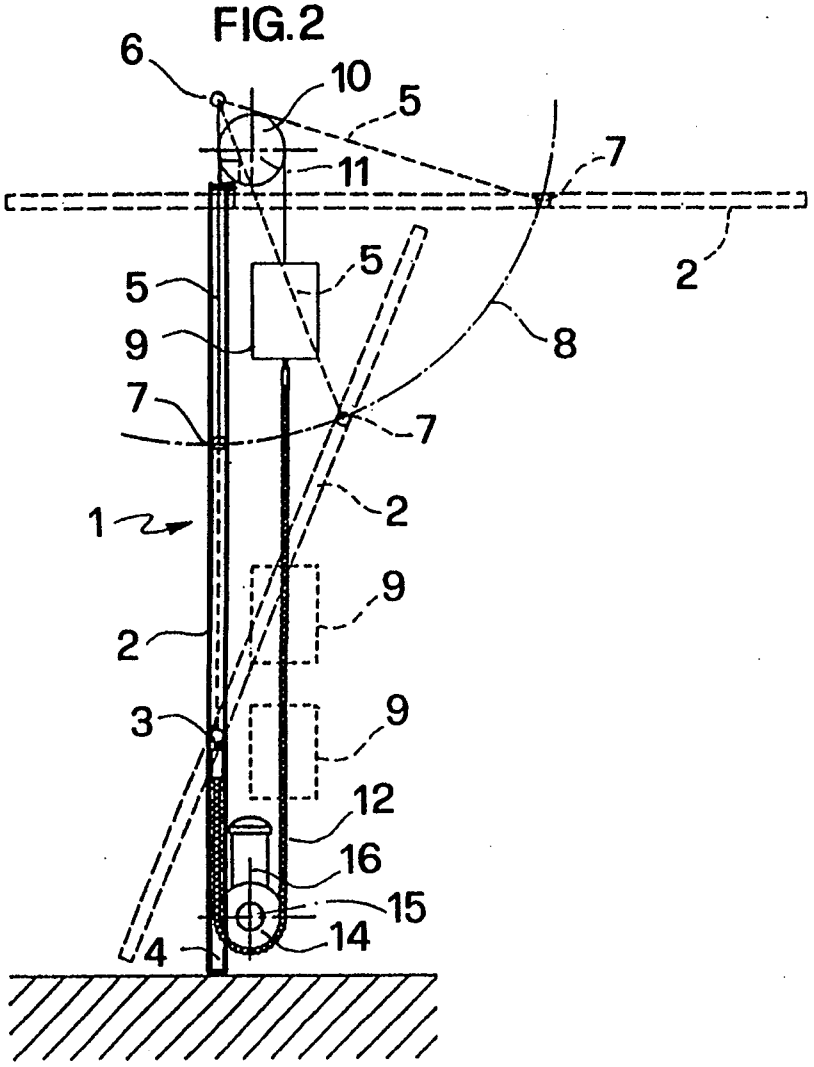
FIG. 2 shows a corresponding view of a motorized overhead door according to the invention.

In the example shown in FIG. 2, a door of the type of FIG. 1 is motorized simply by connecting at least one of the two side supports 3 to the respective counterweight 9 by a chain 12 of rollers which forms an endless ring with cable 13. The chain 12 is in engagement with a lower pulley 14, having an axis 15 parallel to the axis of the upper pulley 10. The pulley 14 is mounted on the output shaft of a motor and reducing gear unit 16, including an electric motor and a screw-wheel reducing unit, for example of the type used for driving electric car windows.

Since the door is balanced by counterweights 9, the motor and reducing unit can have a low power. Activation thereof in either direction cause the lowering or raising respectively of counterweights 9 and consequential opening or closing of the door.

Figure 3:
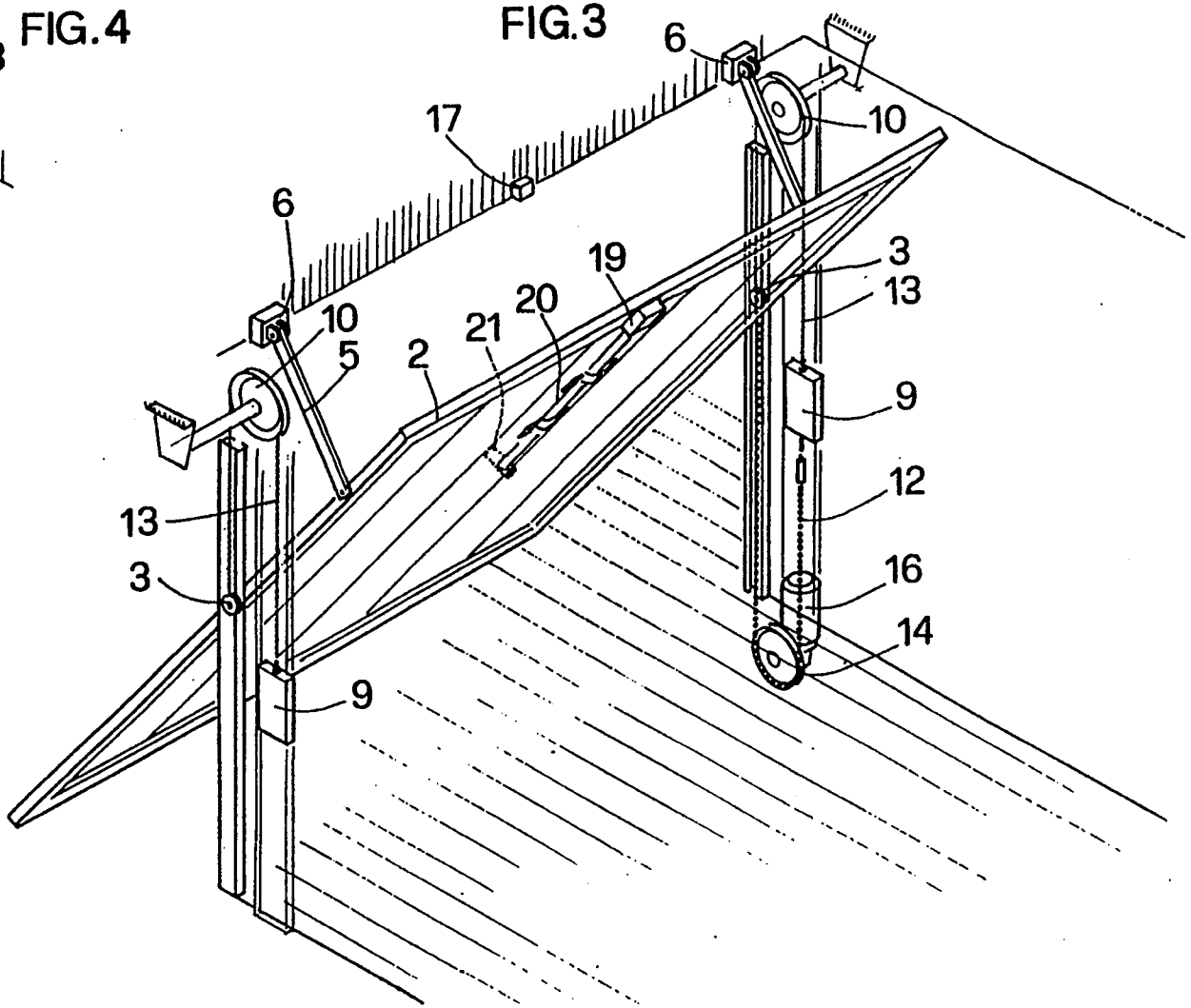
FIG. 3 shows a perspective view of the door of FIG. 2.
Figure 4:
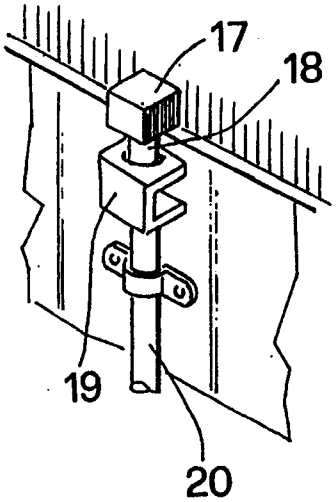
FIG. 4 shows in an enlarged scale a detail of the door according to the invention.

The embodiment of FIG. 2 is also visible in perspective view in FIG. 3, which clearly shows that the above described arrangement is provided only on one side of the door and is located inside the upright forming part of the fixed frame of the door and containing the counterweight. However, it is also possible to provide the same arrangement on both sides of the door. FIG. 3 shows also a bolt device for locking the door in its closed condition. This device comprises a bolt 18 driven by a solenoid 17, which is visible in an enlarged scale in FIG. 4. The inner construction details of this device are not shown since they can be of any known type. The device 17 is mounted on the fixed structure over the door. The bolt 18 cooperates with a coupling element 19 carried by the door in order to lock the latter in the closed position. The bolt is biased by spring means (not shown) into the position engaging element 19 and can be disengaged from the latter by a solenoid control device of the type usually used in electric door latches. The coupling element 19 is not mounted in fixed position on the door 2, and can be moved away from engagement with the bolt by a mechanism 20 with a handle 21 provided with a key-operable latch. Thus, it is possible to open the door when the latter is locked and an interruption of power supply has occurred. The handle may be that usually provided in all non-motorized overhead doors.

The door according to the invention is preferably provided with a safety device of any known type, as a friction coupling on the shaft of the motor and reducing unit or with a device for controlling the current absorption of the motor, in order to protect the system and as a safety measure in case anything prevents the movement of the door. In case a torque limiting friction coupling device is used, this device is preferably of the type which allows the maximum transmissable torque to be adjusted.

Naturally, the principle of the invention remaining the same, the details of construction and the embodiments may widely vary with respect to the described example.

What is claimed is:

1. Motorized overhead swinging door for a garage or the like, of the type comprising:

a fixed support frame, including two vertical side guides, two side supports movable within said side guides, a door structure swingably mounted around a horizontal axis on said supports and also connected to said fixed frame by two pivoted side arms, a pair of counterweights slidably guided along the vertical direction within said fixed frame and each connected to a respective one of said side supporters by cable means directed over a respective upper pulley having a fixed axis, and a motor unit for driving the door, wherein at least one of said counterweights is connected to the respective side support both, on the upper side, by said cable means and, at the lower side, by chain means which forms an endless ring with said cable means, said chain means being directed around a respective lower wheel and said motor unit being arranged to drive said lower wheel.

2. Motorized overhead swinging door according to claim 1, said motor unit includes an electric motor and a reducing gear located within said fixed frame.

3. Motorized overhead swinging door according to claim 2, wherein said motor unit is a conventional unit available in the market, of the type adapted to cooperate with roller chain means, such as for car electric windows.

4. Motorized overhead swinging door according to claim 1, wherein said door is provided with a bolt device driven by a solenoid for locking the door in the closed condition.

5. Motorized overhead swinging door according to claim 4, wherein the bolt device includes a bolt carried by the fixed frame and a coupling element cooperating with the bolt carried by the door, said bolt being movable towards an opened position by said solenoid.

6. Motorized overhead swinging door according to claim 5, wherein when the door is locked said coupling element can be retracted towards a bolt disengaging position by a manually operable mechanism, so as to allow the opening of the door in case an interruption in the supply to the solenoid control means occurs.

7. Motorized overhead swinging door according to claim 6, wherein said manually operable mechanism includes a key-operable latch.

8. Motorized overhead swinging door according to claim 1, wherein the above described arrangement is provided only of one side of the door.

9. Device for motorizing an overhead swinging door, said door being of the type comprising:

a fixed support frame, including two vertical side guides, two side supports movable within said side guides, a door structure, swingably mounted around a horizontal axis on said side supports and also connected to the fixed frame by two pivoted side arms, a pair of counterweights slidably guided along the vertical direction within said fixed frame and each connected to a respective one of said supports by cable means redirected over a respective upper pulley having a fixed axis, wherein said device includes, at least for one of said counterweights:

chain means which connect said counterweight, at the lower side, to the respective side support, so as to form an endless ring with said cable means, a lower wheel engaging said chain means and redirecting said chain means, and a motor unit connected to said lower wheel for driving said lower wheel.

* * * * *